United States Patent [19]

Van Den Sype et al.

[11] 4,042,421

[45] Aug. 16, 1977

[54] METHOD FOR PROVIDING STRONG TOUGH METAL ALLOYS

[75] Inventors: Jaak Stefaan Van Den Sype, Mount Kisco; William Alphonse Kilinskas, Cortlandt, both of N.Y.; Richard Benedict Mazzarella, Indianapolis, Ind.; John Bernard Lightstone, White Plains, N.Y.

[73] Assignee: Union Carbide Corporation, New York, N.Y.

[21] Appl. No.: 637,452

[22] Filed: Dec. 3, 1975

[51] Int. Cl.[2] ..... C21O 9/52

[52] U.S. Cl. ..... 148/12 E; 148/12.3; 148/12.4; 148/38; 148/125

[58] Field of Search ..... 148/12 E, 12.3, 12.4, 148/125, 37, 38

[56] References Cited

U.S. PATENT DOCUMENTS

| | | | |
|---|---|---|---|
| 2,395,608 | 2/1946 | Aborn | 148/12 E |
| 2,974,778 | 3/1961 | Ellis et al. | 205/21 |
| 3,152,934 | 10/1964 | Lula et al. | 148/12.3 |
| 3,197,851 | 8/1965 | Aleck | 29/421 |
| 3,473,973 | 10/1969 | Maekawa et al. | 148/12.3 |
| 3,486,361 | 12/1969 | Vaneman et al. | 72/278 |
| 3,615,921 | 10/1971 | Delgrosso | 148/125 |

*Primary Examiner*—W. Stallard
*Attorney, Agent, or Firm*—Saul R. Bresch

[57] ABSTRACT

A method for improving the strength and toughness of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C and an Ms temperature of no higher than about minus 100° C comprising the following steps:

a. deforming the alloy at a strain of at least about 10 percent at a temperature in the range of about Md minus 50° C to about Md plus 50° C, said Md temperature being that of the alloy undergoing deformation, in such a manner that the material has a martensite phase of no greater than about 10 percent by volume and an austenite phase of at least about 90 percent by volume; and b. deforming the material produced in step (a) at a strain of at least about 10 percent and at a temperature no higher than minus 75° C in such a manner that the material has a martensite phase of at least about 50 percent by volume and an austenite phase of at least about 10 percent by volume; and an aged crystalline microstructure consisting essentially of a stainless steel alloy of the AISI 300 series having a martensite phase of at least about 50 percent by volume and an austenite phase of at least about 10 percent by volume and wherein the tensile strength of the alloy is at least about 190,000 pounds per square inch where the microstructure contains 50 percent martensite by volume and the tensile strength increases by at least about 2000 pounds per square inch for each additional percent of martensite above 50 percent.

14 Claims, 6 Drawing Figures

FIG. 1
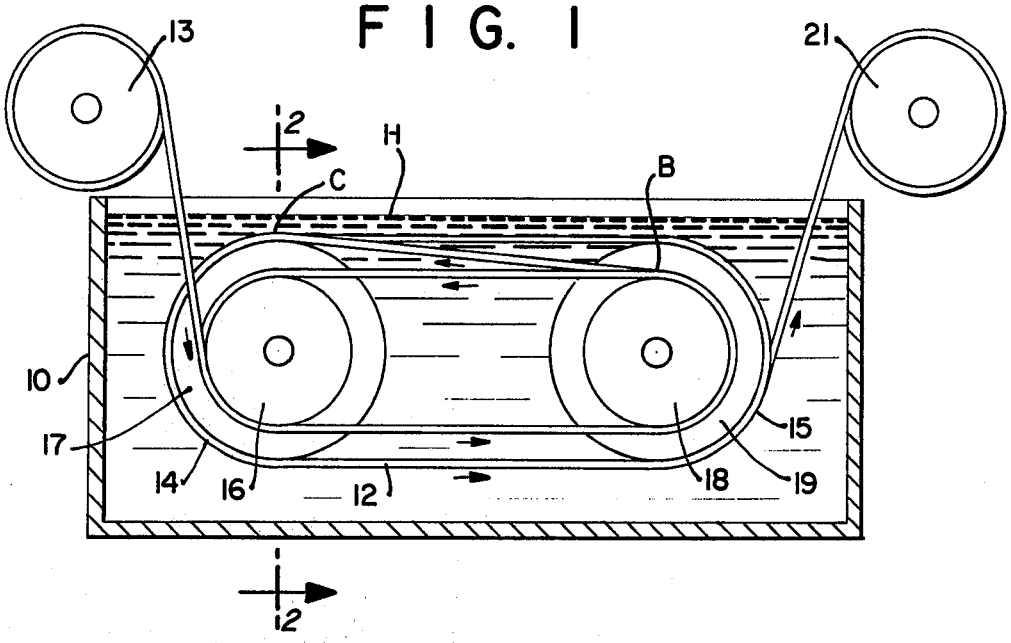
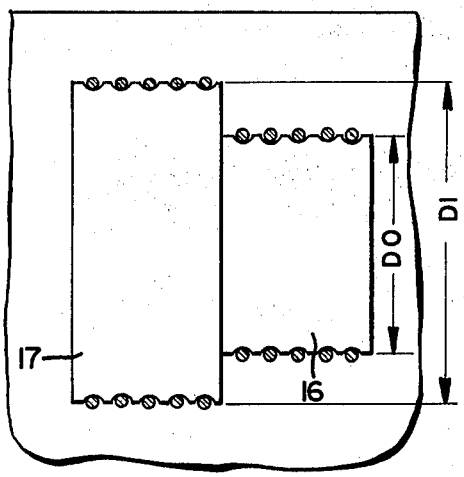
FIG. 2
FIG. 5
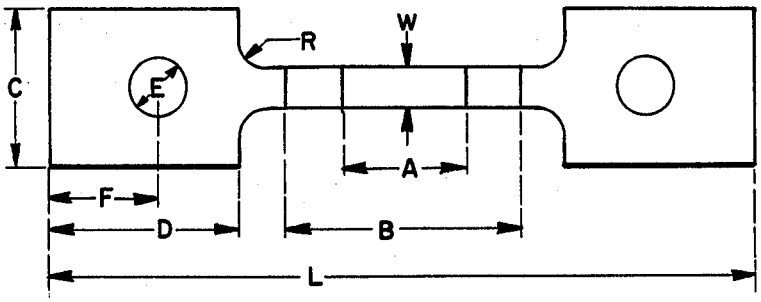

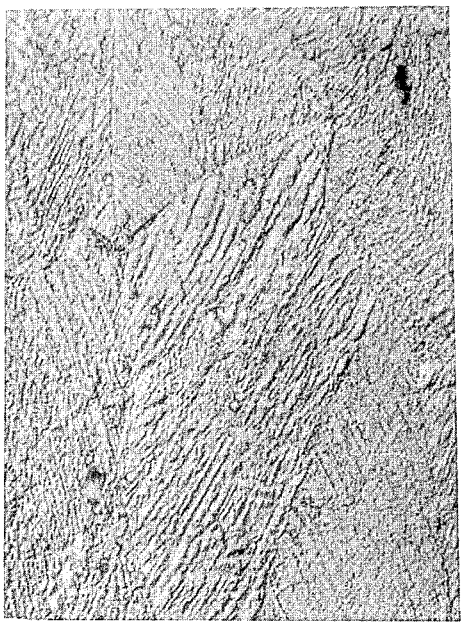
FIG. 3
FIG. 4
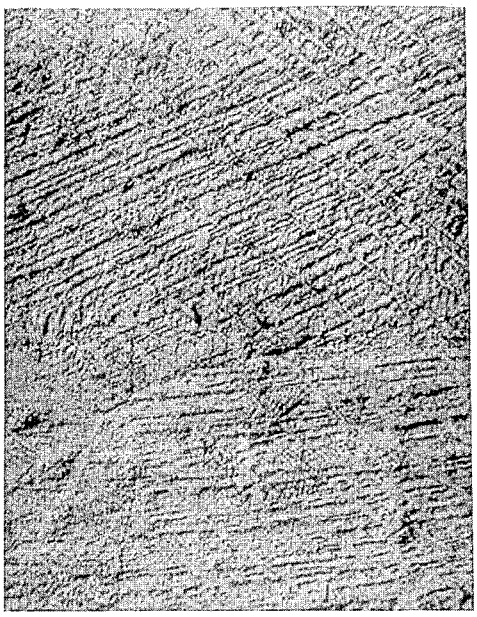

METHOD FOR PROVIDING STRONG TOUGH METAL ALLOYS

FIELD OF THE INVENTION

This invention relates to a process for improving the strength and toughness of various metal alloys and to a unique microstructure characteristic of metal alloys, which have been subjected to the process.

DESCRIPTION OF THE PRIOR ART

The chemical compositions of the metal alloys to which this invention is directed are well known and include those alloys listed in the "Steel Products Manual: Stainless and Heat Resisting Steels" published by the American Iron and Steel Institute (AISI) now of Washington, D.C. in 1974 and designated as austenitic with the further proviso that these alloys at least initially have an Md temperature of no higher than about 100° C (i.e., plus 100° C) and an Ms temperature no higher than minus 100° C. It will be apparent that the AISI Series Designation 200 and 300 are of interest here. Other alloys contemplated here, again, must be austenitic and have the stated Md and Ms temperatures. These alloys include certain manganese-substituted non-stainless alloys containing iron, manganese, chromium, and carbon exemplified by those alloys designated by DIN (Deutsche Industrie Norme) specifications X40 Mn Cr 18 and X40 Mn Cr 22 and described on pages 655 and 656 of the Metallic Materials Specification Handbook published by E & FN Spon Ltd., London 1972.

The term "austenitic" involves the crystalline microstructure of the alloy, which is referred to as austenitic or austenite when at least about 95 percent by volume of the microstructure has a face-centered cubic structure. Such alloys can be referred to as being essentially or substantially in the austenitic phase. It is understood that the alloys of concern here are essentially in the austenitic or austenite phase at the temperature at which the first deformation step is carried out regardless of the work or temperature previously applied, e.g., the metal or alloy subjected to the first deformation step may have been previously annealed yet it is essentially austenitic when the first step is applied.

The other microstructure with which we are concerned here is a body-centered cubic structure and is referred to as martensitic or martensite. When at least about 95 percent by volume of the structure is martensitic, the alloy is considered to be essentially or substantially in the martensite phase.

The microstructure can, of course, contain both an austenite phase and a martensite phase and the processing to be descussed here both in terms of the prior art and the present invention in one of transformation of at least part of the austenite to martensite thus changing the microstructure of the alloy treated.

The Md temperature is defined as the temperature above which no martensitic transformation will take place regardless of the amount of mechanical deformation which is applied to the metal or alloy and can be determined by a simple and conventional tensile test carried out at various temperatures.

The Ms temperature is defined as the temperature at which martensitic transformation begins to take place spontaneously, i.e., without the application of mechanical deformation. The Ms temperature can also be determined by conventional tests.

Some examples of Md temperatures are as follows:

| AISI stainless steel type no. | Md temperature (° C) |
|---|---|
| 301 | 43 |
| 302 | 13 |
| 304 | 15 |
| 304L | 18 |

The 301, 302, 304 and 304L steels have Ms temperatures below minus 196° C.

As noted, the deformation referred to is a mechanical deformation, and takes place in the area of plastic deformation, which follows the area of elastic deformation. It is caused by subjecting the material to a stress beyond its elastic limit sufficient to change the shape of all or part of the workpiece.

The physical properties relevant to the present invention include those of strength and toughness. The strength property can readily be determined from a simple uniaxial tensile test as described in ASTM standard method E-8. This method appears in part 10 of the 1975 Annual Book of ASTM Standards published by the American Society for Testing and Materials, Philadelphia, Pa. The results of this test on a material can be summarized by stating the yield strength, tensile strength, and total elongation of the material: (a) the yield strength is the stress at which the material exhibits a specified limiting deviation from the proportionality of stress to strain. In this specification, the limiting deviation is determined by the offset method with a specified 0.2 percent strain; (b) the tensile strength is the maximum tensile stress which the material is capable of sustaining. Tensile strength is the ratio of the maximum load during a tension test carried to fracture to the original cross sectional area of the specimen; and (c) the total elongation is the increase in gauge length of a tension test specimen tested to fracture, expressed as a percentage of the original gauge length. It is generally observed that when the yield and tensile strengths of metallic materials are increased through metallurgical processes, the total elongation decreases.

In order for material to be satisfactory for use in highly stressed structures, it is not only important that the material have sufficiently high yield and tensile strengths, but also that the material have adequate resistance to brittle failure. In this regard, metallurgical investigations have shown that sharp cracks can concentrate the applied stresses to a material manyfold and it was found that the behavior of the material under such stress concentrations at crack tips determine to a large degree whether the material is of a ductile or brittle nature. Fracture toughness of a material is a measure of its resistance to brittle failure in the presence of sharp cracks. ASTM specification E-399 describes a method for determining the fracture toughness of metallic materials by a compact test of a notched and fatigued precracked specimen. The results are given in terms of the stress-intensity factor $K_c$ which is a measure of the stressfield intensity near the tip of the fatigue precrack under conditions for which crack advance is observed to initiate. High values of $K_c$ indicate good fracture toughness. Valuable supplementary information can be obtained from the appearance of the fracture surface which is described as full oblique when the fracture mode is ductile and flat when the fracture mode is brittle. Fracture toughness of rolled sheet metal usually depends on the direction of propagation of the crack in relation to the rolling direction. In this specification, the ASTM E-399 method is used to indicate crack plane orientation.

The form or shape of the material to which the prior art and present invention are directed is not material. Any shape can be used such as plates, sheets, strip, foil, bars, wire, rods, blooms, billets, slabs, and a variety of other shapes, all prepared and handled by conventional techniques.

It has been found that deformation of the metals and alloys referred to above at cryogenic temperatures, usually that of liquid nitrogen (about minus 196° C), improves the tensile strength of the material appreciably, e.g., the cryodeformation of annealed AISI 304 stainless steel at minus 196° C without conventional ageing was able to provide a tensile strength of 240,000 psi (1,654 Mpa) and with conventional ageing a tensile strength of 280,000 psi, quite an improvement over the untreated annealed AISI 304 stainless steel, which has an approximate tensile strength of 84,000 psi. On analysis of the aged cryodeformed stainless steel it was further found that its microstructure was essentially martensite. Since high martensite content tends to promote brittleness and low toughness, it was soon realized that the prior art cryodeformation technique, while improving tensile strength, left its material in a relatively brittle state with correspondingly low ductility. In view of the fact that properties are relative, some material applications raised no problems; for other applications, however, the deficiencies were apparent. Applications in which the high strength-toughness combination is a prerequisite are exemplified by pressure vessels. High strength materials allow the construction of economically desirable lightweight vessels. However such vessels should not shatter when burst under pneumatic loading conditions. This requires materials with high fracture toughness. Another example is coil springs which require materials with high strength and a low sensitivity to notches or cracks for improved fatigue life.

This observation concerning strength and toughness with respect to prior art cryodeformed alloys together with the constant preoccupation of the metallurgical industry with the improvement of physical properties of metals and alloys, in general, and the need for the high strength-toughness combination in a host of applications led to the conclusion that need for improvement existed along these particular lines.

SUMMARY OF THE INVENTION

An object of this invention, therefore, is to provide an improvement in known cryodeformation processes whereby strengths at least as great as those of the prior art are achieved while concurrently obtaining toughness values that are greater than those which the prior art was capable of obtaining in combination with the high strength factor.

Other objects and advantages will become apparent hereinafter.

According to the present invention, a process has been discovered, which not only equals, but unexpectedly, and markedly, betters the tensile strength achieved by prior art cryodeformation processes in combination with the obtainment of higher toughness values for the corresponding strength factor, using an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C and an Ms temperature of no higher than about minus 100° C comprising the following steps:

a. deforming the alloy at a strain of at least about 10 percent and at a temperature in the range of about Md minus 50° C to about Md plus 50° C, said Md temperature being that of the alloy undergoing deformation, in such a manner that the material has a martensite phase of no greater than about 10 percent by volume and an austenite phase of at least about 90 percent by volume; and b. deforming the material produced in step (a) at a strain of at least about 10 percent and at a temperature no higher than minus 75° C in such a manner that the material has a martensite phase of at least about 50 percent by volume and an austenite phase of at least about 10 percent by volume.

The strain applied in step (a) will on occasion be referred to in this specification as "prestrain" while the strain applied in step (b) will merely be referred to as strain or second step strain.

Final optimization of the strength property is achieved by subjecting the metal alloy to conventional ageing at a temperature in the range of about 350° C to about 450° C.

By application of conventional analytical techniques, such as X-ray difraction and electron microscopy, to stainless steel alloys of the AISI 300 series treated by the process of this invention with ageing, it is observed that a novel aged crystalline microstructure is present having the same chemical composition as initially used (without regard to surface impurities) and having a martensite phase of at least about 50 percent by volume and an austenite phase of at least about 10 percent by volume and wherein the tensile strength of the alloy is at least about 190,000 pounds per square inch where the microstructure contains 50 percent martensite by volume and the tensile strength increases by at least about 2000 pounds per square inch for each additional percent of martensite above 50 percent.

A feature of this invention and a specific application of the process concerns a method for improving the tensile strength and toughness of wire or strip having a cmposition which consists essentially of an austenitic stainless steel alloy of the AISI 300 series having an Md temperature of no higher than about 100° C and an Ms temperature of no higher than about minus 100° C comprising the following steps:

a. deforming the wire or strip at a strain of at least about 10 percent and at a temperature in the range of about Md minus 50° C, said Md temperature being that of the alloy undergoing deformation, in such a manner that the wire or strip has a martensite phase of no greater than about 10 percent by volume and an austenite phase of at least about 90 percent by volume; and b. stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

Again, strength is preferably optimized by subjecting the stretched wire or strip to conventional ageing at a temperature in the range of about 350° C to about 450° C.

BRIEF DESCRIPTION OF THE DRAWING

FIGS. 1 and 2 are schematic diagrams illustrating the side view of apparatus, and cross-section in part, which can be used to carry out the stretching step referred to above.

FIGS. 3 and 4 are photomicrographs at 20000X magnification of the crystalline microstructure of material.

FIG. 5 is a schematic diagram of a specimen cut from an alloy and used in certain of the examples.

DESCRIPTION OF THE PREFERRED EMBODIMENT

Figure 6:
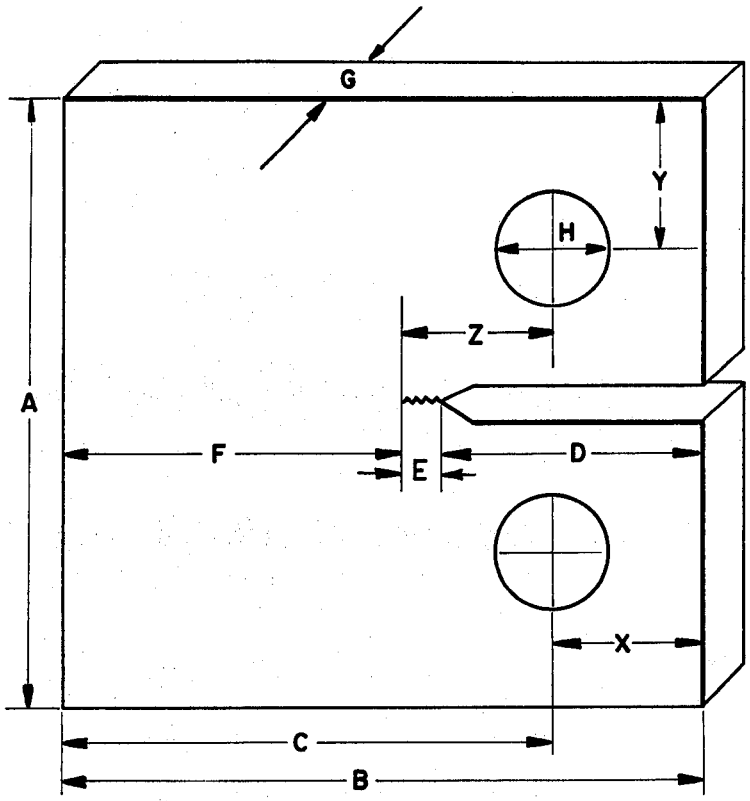
FIG. 6 is a schematic diagram of another specimen used for fracture toughness testing in certain of the examples.

The alloys to which the process is applied are described above and, as noted, are conventional. The only prerequisites are that when the first deformation step is applied they meet the definition of austenitic, and their Md temperatures are no higher than about 100° C and their Ms temperatures are no higher than about minus 100° C.

The deformation is mechanical and takes place in that region known as the region of plastic deformation.

The mechanical deformation techniques which can be used both in the first and second deformation steps again are conventional as well the apparatus availed of to carry out these techniques, which, for example, include rolling, forging, stretching, drawing, spinning, bending, swaging, hydroforming, explosive forming, and roll forming. It will be readily apparent to those skilled in the metallurgical arts what apparatus can be used for the various techniques which range from simple tension to the most complex mechanical deformation operations.

The deformations must, of course, be sufficient to provide the stated percentages of martensite and austenite, which are first determined by conventional analytical techneques such as X-ray diffraction or magnetic measurements and then on the basis of the experience of the operator with the various alloys on deformation in the noted temperature ranges. To more accurately define deformation, it has been set forth in terms of strain. Although the strains occurring during process deformations are usually more complex than those occurring during a simple tension test, it is found that for the materials to which the invention applies, the strengthening effects that occur during complex deformations can be evaluated from the observed strengthening effects during a simple tension test using the principle of "equivalent uniaxial" strain or "effective" strain as set forth, e.g., in "Mechanical Metallurgy" by G. E. Dieter, Jr., published by McGraw-HillBook Company (1961), on page 66.

The minimum strain in the first deformation is at least about 10 percent. There is no upper limit for percent strain except that of practicality in that at a certain point the change in microstructure and strength-toughness properties become minimal and, of course, there is a limit as to fracture of the material. In any case the suggested strain range in this first step is from about 10 to about 80 percent and, preferably, about 20 to about 60 percent.

As pointed out, the initial alloy utilized in the process is at least about 95 percent by volume austenite, the balance being martensite. Under deformation in the first step (or prestrain), the alloy may be changed slightly from a microstructural point of view so that 0 to about 10 percent by volume is in the martensite phase and about 90 to about 100 percent by volume is in the austenite phase, and there is, preferably, 0 to about 5 percent by volume martensite and about 95 to about 100 percent by volume austenite.

The prestrain step is conducted at a temperature in the range of about Md minus 50° C to about Md plus 50° C, said Md temperature being that of the alloy undergoing deformation, e.g., where the Md temperature is 43° C, Md minus 50° C will equal minus 7° C and Md plus 50° C will equal 93° C. The alloys under consideraton here are considered stable, i.e., austenitically stable, at these first step temperatures even though they undergo the changes set forth above when subjected to deformation.

The second deformation step, is similar to the first deformation step insofar as deformation or strain is concerned. Again, sufficient strain must be applied to provide the stated percentages of martensite and austenite, first determined by conventional analysis and then by reliance on operator experience. The minimum strain applied in the second deformation is at least about 10 percent. Here, also, there is no upper limit for percent strain except the bounds of practicality in that change in microstructure and strength-toughness properties tend to become minimal and there is a limit due to fracture of the material. The suggested strain range is about 10 to about 60 percent and is, preferably, about 20 to about 40 percent.

It will be understood by those skilled in the art that the strain requirement, i.e., at least about 10 percent strain, in the first and second deformation steps refers to a strain applied to all or any part of the workpiece. Of course, the advantages of the process will only be found in that region where the minimum strain of at least about 10 percent is applied. This is particularly important in dealing with complex shapes, for example, pressure vessels or cylinders that have discontinuities at weld points, or in any other workpiece that has a discontinuity or fault due to design, construction, or both which provides a built-in or inherent local stress concentration in certain regions of the workpiece. It is found in these cases that a strain of less than about 10 percent and as low as about 2 or 3 percent applied to the entire workpiece will result in a strain of at least about 10 percent in the region or regions of discontinuity or fault and, therefore, the advantages of the subject process can be localized where this is desirable since this procedure can be used to upgrade the most vulnerable regions of the workpiece to provide uniformity in the physical properties throughout the workpiece. It follows that where strains of at least about 10 percent or higher are applied to the entire workpiece even higher strains will result at these discontinuities, all to the advantage of the technician who has to meet specifications for specific applications where uniformity is not a prerequisite.

The temperature at which the second step deformation is conducted is less than about minus 75° C and is , preferably, less than about minus 100° C. These temperatures can be achieved by carrying out the second step in liquid nitrogen (B.P. minus 196° C); liquid oxygen (B.P. minus 183° C); liquid argon (B.P. minus 186° C); liquid neon (B.P. minus 246° C); liquid hydrogen (B.P. minus 252° C); or liquid helium (B.P. minus 269° C). Liquid nitrogen is preferred. A mixture of dry ice and methanol, ethanol, or acetone has a boiling point of about minus 79° C and can also be used. The lower the temperature, the less the strain needed for each percent of improvement in tensile strength. It should be noted here that the deformation introduces energy into the material and this causes a rise in temperature, which may end up in a range above about minus 75° C. This will not effect the process provided the conditions of the second step deformation are carried out prior to the temperature rise. Further, cooling to the defined low temperatures can take place prior to or at the same time as deformation, the closer the coordination between the two the faster and, consequently, more economical the process.

Under the second deformation step, the microstructure of the metal or alloy is changed appreciably so that at least 50 percent by volume is in the martensite phase and at least 10 percent by volume is in the austenite phase. The preferred range lies in the area of about 60 to about 90 percent by volume martensite and about 10 to about 40 percent by volume austenite. It is believed that the high austenite content contributes to the toughness of the processed material.

At all times in this specification the microstructure of the initial alloy and of the products of the prestrain, cryodeformation, and ageing is considered to consist essentially of austenite and/or martensite in the percentages previously stated. Any other phases present are not of interest here since such phases, if they are present at all, are less than about one percent by volume and have little or no effect on the properties of the alloy.

It is noted that the ranges, in which the strain percentages for the first and second steps lie, overlap. Although the percentages can be the same, it is preferred that the ratio of prestrain to second step strain is in the range of about 1:1 to about 3:1.

After the second step, the alloy is preferably subjected to ageing to optimize strength. Ageing is carried out in a conventional manner at a temperature in the range of about 350° C to about 450° C and, preferably, in the range of about 375° C to about 425° C. Ageing time can range from about 30 minutes to about 10 hours and is preferably in the range of about 30 minutes to about 2.5 hours. Conventional testing is used here to determine the temperature and time, which give the highest tensile strength and yield strength.

It will be noted, that ageing tends to improve yield strength even more than tensile strength, and for the alloy to reach the highest strength levels can be carried to a point where yield strength approximates the tensile strength.

It was previously pointed out that a new and unique microstructure results from the application of the process of this invention to stainless steel alloys of the AISI 300 series. This microstructure is aged and consists essentially of a martensite phase of at least about 50 percent by volume and an austenite phase of at least about 10 percent by volume and the alloy has a tensile strength of about 190,000 pounds per square inch where the microstructure contains 50 percent martensite by volume and the tensile strength increases by at least about 2000 pounds per square inch for each additional percent of martensite above 50 percent. (190,000 psi = 1,300 Mpa and 2000 psi = 14 Mpa).

A preferred aged microstructure consists essentially of at least about 60 percent by volume of a martensite phase and at least about 10 percent by volume of an austenite phase, the alloy having a tensile strength of about 210,000 psi to about 260,000 (1,791 Mpa) psi where the microstructure contains 60 percent martensite by volume and about 270,000 to about 325,000 (2,239 Mpa) where the microstructure contains 90 percent martensite.

The defined microstructure is one that has had conventional ageing as described above applied to it.

FIG. 3 is an optical photomicrograph at 2,000 × magnification of a microstructure prepared according to the invention. The alloy is AISI 302. After a conventional annealing treatment, the steel is strained twenty percent at room temperature, subsequently strained twenty percent at minus 196° C and finally aged 1½ hours at 400° C. The martensite content is approximately seventy-five percent by volume.

FIG. 4 is an optical photomicrograph at 2,000 × magnification prepared according to a prior art cryodeformation technique. The alloy is AISI 302. After a conventional annealing treatment, the steel is strained 20 percent at minus 196° C and aged 1½ hours at 400° C. The martensite content is approximately seventy-five percent by volume.

Those skilled in the art will observe the structural differences between the microstructure obtained with the present invention (FIG. 4) and the microstructure obtained with the prior art (FIG. 5). The martensite laths obtained with the present invention are generally shorter, are more curved and often present a "dendritic" type appearance whilst the martensitic laths in FIG. 5 are longer, straighter and form intersecting bands along crystallographic orientations.

The most important distinction, although obviously dependent on the microstructure, is not defined wholly in terms of structure, but rather in terms of an important property in relation to the microstructure, i.e., that tensile strength for each percent of martensite in the alloy is higher than has been heretofore known.

As previously noted, a feature of this invention and a specific application of the process concerns a method for improving the tensile strength and toughness of wire or strip, the composition of which consists essentially of an austenitic stainless steel alloy of the AISI 300 series having an Md temperature of no higher than about 100° C and an Ms temperature of no higher than about minus 100° C comprising the following steps:

a. deforming the wire or strip at a strain of at least about 10 percent and at a temperature in the range of about Md minus 50° C to about Md plus 50° C, said Md temperature being that of the alloy undergoing deformation, in such a manner that the wire or strip has a martensite phase of no greater than about 10 percent by volume and an austenite phase of at least about 90 percent by volume; and b. stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

The tensile strength, as discussed heretofore, is preferably optimized by subjecting the stretched wire or strip to conventional ageing at a temperature in the range of about 350° C to about 550° C.

The generic process described above including, of course, the various preferred ranges and the microstructure are applicable to the stretching process and will not be repeated.

It may be well to point out, however, that this process combining prestrain and low temperature deformation is an improvement over stretching wire or strip at low temperatures, which, in its own right, has the advantages of providing a higher tensile strength, independent from wire diameter or strip thickness, than drawing or rolling at low temperatures where the tensile strength is intimately related to the diameter or thickness, i.e., the greater the diameter or thickness, the lower the tensile strength; improved torsional yield; and eliminating the need for lubricants.

Stretching is defined as a deformation of workpieces in which one dimension, called the longitudinal direction, is much larger than the two other dimensions, e.g., wire or strip. This deformation comprises applying forces in the longitudinal direction so that essentially the entire cross-section of the workpiece is under uniform uniaxial tensile stress during the deformation. The tensile stresses are of sufficient magnitude to induce permanent plastic deformation in the workpiece, the application of stess being described in terms of percent strain. Since the term "stretching" as used herein is in contradistinction to other deformation processes such as drawing and rolling which involve multiaxial states of stress, the term "stretching uniaxially" has been used to further accentuate the difference for as those skilled in the art will recognize the longitudinal elongation of a wire during drawing through a die occurs under the influence of compressive stresses in directions transverse to the drafting direction in addition to the tensile stresses in the drafting or longitudinal direction.

Two forms of material are of particular interest in the instant stretching process because of their peculiar dimensions, i.e., the longitudinal direction being much larger than the other two dimensions. These forms are wire and strip which have this common dimensional characteristic. It has been pointed out that the second step prescribed here is a non-drawing and a non-rolling step to emphasize the importance of uniaxial stretching and exclude the techniques whereby the workpiece is not uniformly strengthened, i.e., where the skin portion is highly strengthened while the core portion is strengthened to a much lesser degree, thus limiting the tensile strength of the drawn wire or rolled strip to that at which the skin portion cracks or ruptures. This deficiency in drawn wire leads to further problems in a specific application, i.e., that of coil springs,, where formability is of special interest. In this case, the skin portion has to be sufficiently ductile to withstand wrapping without fracture about an arbor with a diameter at least equal to the diameter of the wire, but, unfortunately the preferential work-hardening of the skin during drawing causes the skin to become more brittle and less ductile thus reducing formability.

The low temperature stretching process is shown to have improved tensile strength and formability as well as torsional and fatigue properties. The prestrain step improves even further on the tensile strength and toughness of the wire or strip thus optimizing these materials for commercial use.

Just as for the generic process described above, this process can be conducted using conventional apparatus. The first step deformation can be carried out by conventional drawing or rolling in the defined temperature range under the also heretofore defined strain, the wire or strip, of course, being essentially austenitic, annealed or not as desired. Other kinds of deformation can also be applied to accomplish the prestrain. No particular achievement in tensile strength is required in this step. In any case, it is limited by the combination of materials, strain, and temperature used in the step.

The second step deformation must be conducted in the prescribed temperature range, i.e., at a temperature less than minus 75° C, and the defined strain must be achieved by stretching to obtain all of the benefits of this feature of the invention. Otherwise, conventional techniques and apparatus, again, can be used to accomplish the step.

One form of apparatus, which is useful in carrying out the second step stretching where wire is the workpiece, and the procedure used in connection therewith can be described as follows with reference to FIGS. 1 and 2: the process is carried out in an insulated tank 10 filled to a certain level H with a cryogenic fluid, such as liquid nitrogen, the quantity of fluid being such that it completely covers the stretching operation. The prestrained wire 12 is fed from a supply spool 13 into tank 10 and is passed around a pair of capstans 14 and 15, which are rotatably disposed in tank 10 beneath the surface of the fluid. The two capstans are identical, and they each are comprised of two cylindrical rolls of different diameters. A cross section of capstan 14 taken along line 2—2 of FIG. 1 appears in FIG. 2 and shows grooves with wire being guided in the grooves to prevent "walking". The outer groove of roll 16 is the groove farthest removed from roll 17; the inner groove of roll 16 is the groove adjacent to roll 17; the inner groove of roll 17 is the groove adjacent to roll 16; and the outer groove of roll 17 is the groove farthest removed from roll 16. The diameter of the narrow roll is designated DO and the diameter of the wide roll is designated D1. After entering the cryogenic fluid, wire 12 is carried in the direction of the arrows along the outer groove of roll 16 of capstan 14 around roll 16 and then passes to the outer groove of roll 18 of capstan 15 and continues to go back and forth between rolls 16 and 18 through the grooves provided therefor to the inner grooves while gradually cooling down to the temperature of the cryogenic fluid. The tractive force on wire 12 also builds up gradually through friction until the wire reaches a point B on the inner groove of roll 18 where it passes to point C on the inner groove of roll 17 of capstan 14. Since both capstans rotate at the same angular velocity, a uniform stretching takes place. The amount of stretch is equal to D1 − D0/D0. After point C, the wire continues from roll 17 to roll 19 from the inner groove to the outer groove in a similar fashion to its progress along rolls 16 and 18, gradually moving to the outer grooves while the tractive forces decrease. After passing through the outer groove of roll 19, wire 12 leaves tank 10 and is wound on takeup reel 21.

The following examples illustrate the invention (all specimens in all examples contain at least 95 percent by volume austenite prior to first step deformation and at least 90 percent by volume austenite prior to cryodeformation):

EXAMPLES 1 to 31

Annealed AISI type 304 stainless steel sheet is used, the chemical compositions being as follows:

| Element | Percent by Weight |
|---|---|
| C | 0.0555 |
| S | 0.020 |
| P | 0.015 |
| Mn | 1.83 |
| Si | 0.75 |

-continued

| Element | Percent by Weight |
|---|---|
| Ni | 8.90 |
| Cr | 18.5 |
| Mo | 0.42 |
| Cu | 0.42 |
| V | 0.03 |
| Zr less than | 0.03 |
| Ti | 0.03 |
| Al less than | 0.02 |
| Fe | balance |
| Total | 100 |

Annealing is accomplished with conventional techniques by heating the material between 980° C and 1150° C followed by rapid cooling.

All sheet is received cut in 12 in. (inch or inches) by 12 in. strips and the thickness of all strips is nominally 0.060 in. Specimens are cut according to ASTM E8 with the tensile axis parallel to the rolling direction of the sheet. FIG. 5 is a diagram of the specimens. The reference characters in FIG. 5, their meaning, and their measurement in inches are as follows:

| | |
|---|---|
| A - Inner gauge length and marks | 2.00 ± 0.01 in. |
| B - outer gauge length and marks | 3.00 ± 0.01 in. |
| C - width of grip section | 2 in. |
| D - length of grip section | 2½ in. |
| E - diameter of hole for pinning grips | ¾ in. |
| F - edge distance from pin hole | 1¼ in. or 1 in. |
| L - overall length | 9 in. |
| R - radius of shoulder fillet | ½ in. |
| W - width of gauge section | 0.50± 0.01 in. |

Specimens are processed at 21° C (prestrain) and minus 196° C (second step deformation) on a Gilmore Model ST electrohydraulic testing machine at a ram speed of about 0.1 inch per minute. The load is measured by a Gilmore 20,000 pound load cell. At 21° C the extension is measured with an Instron G-51-15 strain gauge extensometer whose gauge length is 1 inch. The outputs of load and extension are converted to stress and strain by an analog computer and plotted on an X-Y recorder during testing. At minus 196° C, the strain is determined by comparing the lengths between gauge marks on a specimen before and after deformation.

Processing at minus 196° C is done in an insulated metal dewar filled with liquid nitrogen so that the entire specimen is immersed in a liquid nitrogen bath. Ageing treatments are carried out on a Lindberg Model 59744 furnace in air. The surface oxidation of the specimens occurring during ageing is assumed not to affect the resulting mechanical properties. The temperature along the length of the specimen does not vary more than ± 10° C from the preset temperature.

Percent strain at each temperature, i.e., at 21° C and minus 196° C; ageing in hours at 400° C; and final properties measured at 21° C are given in Table I.

Examples 1 to 8 illustrate the prior art in that there is no prestrain (or first deformation step). Examples 9 to 33 include the prestrain.

Yield strength is given in psi at 0.2 percent elongation; tensile strength is given in psi; and total elongation in percent. These terms have been defined above.

Percent by volume martensite is given as determined by quantitative X-ray diffraction technique. The balance (to make up a total of 100 percent) is considered to be austenite. Other phases or impurities are not more than one percent by volume and are not considered here. In all examples where percent martensite or percent austenite is given, the balance of 100 percent is essentially made up of the phase, martensite or austenite, for which a percent is not given.

TABLE I

| Example | Strain Percent at 21° C | Strain Percent at −196° C | Ageing in hours | Yield Strength in Ksi at 0.2% (Mpa) | Tensile Strength in Ksi (Mpa) | Total Elongation % based on 1 inch | Martensite % |
|---|---|---|---|---|---|---|---|
| 1 | 0 | 16.5 | 0 | 122 (841) | 176 (1,213) | 15.4 | 74 |
| 2 | 0 | 21 | 0 | 161 (1,109) | 192 (1,323) | 10.3 | 83 |
| 3 | 0 | 25 | 0 | 206 (1,419) | 214 (1,474) | 7.2 | 89 |
| 4 | 0 | 30 | 0 | 200 (1,378) | 212 (1,461) | | 93 |
| 5 | 0 | 16 | 1.5 | 160 (1,102) | 178 (1,226) | | 56 |
| 6 | 0 | 20 | 1.5 | 206 (1,419) | 210 (1,447) | 4 | 74 |
| 7 | 0 | 25 | 1.5 | 241 (1,660) | 241(1,660) | 2 | 83 |
| 8 | 0 | 30.5 | 1.5 | 256 (1,764) | 256 (1,764) | 1 | 91 |
| 9 | 30 | 15 | 0 | 165 (1,137) | 205 (1,412) | 8.5 | 75 |
| 10 | 30 | 19 | 0 | 197 (1,357) | 216 (1,488) | 6.7 | 83 |
| 11 | 30 | 22 | 0 | 223 (1,536) | 229 (1,578) | 2.5 | 88 |
| 12 | 30 | 26 | 0 | 242 (1,667) | 246 (1,695) | 1.2 | 94 |
| 13 | 30 | 15.5 | 1.5 | 180 (1,240) | 231 (1,592) | 1.7 | 61 |
| 14 | 31.5 | 19 | 1.5 | 258 (1,778) | 267 (1,840) | less than 0.5 | 76 |
| 15 | 30 | 23 | 1.5 | 280 (1,929) | 280 (1,929) | 1.7 | 85 |
| 16 | 30 | 25 | 1.5 | 328 (2,260) | 328 (2,260) | 1 | 90 |
| 17 | 50 | 14.5 | 0 | 154 (1,061) | 207 (1,426) | | 67 |
| 18 | 51 | 16.5 | 0 | 190 (1,309) | 222 (1,530) | 6.6 | 76 |
| 19 | 50 | 20 | 0 | 209 (1,440) | 230 (1,585) | 4.2 | 83 |
| 20 | 51 | 20.5 | 0 | 215 (1,481) | 236 (1,626) | 3 | |
| 21 | 50 | 25 | 0 | 244 (1,681) | 254 (1,750) | 1 | 88 |
| 22 | 51 | 24 | 0 | 240 (1,654) | 247 (1,702) | 1.8 | |
| 23 | 50 | 16.5 | 1.5 | 256 (1,764) | 265 (1,826) | less than 0.5 | 62 |
| 24 | 50 | 19.5 | 1.5 | 270 (1,860) | 287 (1,977) | less than 0.5 | 73 |
| 25 | 50 | 23.5 | 1.5 | 316 (2,177) | 318 (2,191) | less than 0.5 | |
| 26 | 60 | 25.5 | 1.5 | 323 (2,225) | 323 (2,225) | less than 0.5 | |
| 27 | 50 | 27 | 1.5 | 308 (2,122) | 311 (2,143) | less than 0.5 | 89 |
| 28 | 60.5 | 24 | 0 | 234 (1,612) | 246 (1,695) | 1.5 | |
| 29 | 60.5 | 25 | 0 | 242 (1,667) | 255 (1,757) | 1.1 | 90 |
| 30 | 60 | 22.5 | 1.5 | 335 (2,308) | 336 (2,315) | less than 0.5 | |
| 31 | 60 | 24 | 1.5 | 321 (2,212) | 325 (2,239) | less than 0.5 | 87 |

Note:
Ksi = 1000 psi
Mpa = megapascal

EXAMPLES 32 to 35

The same material used in examples 1 to 31 is used in these examples except that the thickness of the sheet is nominally 0.172 inch. Two large specimens similar to the shape of the specimen in FIG. 5 are cut from the sheet. The reduced gauge section of the specimens is 3 in. wide and 8 in. long. These specimens are uniaxially stretched at minus 196° C and subsequently aged for 1 hour at 400° C. The stretching direction is oriented parallel to the rolling direction of the sheet. The tensile strength is determined using pin-loaded specimens with 2 inch gauge length according to ASTM method E8. Tensile strengths at 21° C for each of the two specimens are given in Table II next to examples 32 and 33 respectively.

In examples 34 and 35, two specimens of annealed 304 stainless steel in sheets 0.251 inch thick are each rolled, in eight passes at 21° C, to a thickness of 0.186 inch, which corresponds to a 30 percent uniaxial strain. The specimens are then rolled to a thickness of 0.161 inch at minus 196° C in 12 passes, which corresponds to a uniaxial strain of 16 percent. The tensile strengths for each specimen are measured as above and set forth in Table II next to Examples 34 and 35, respectively.

The invention specimens of examples 34 and 35 contain about 67 percent martensite and 33 percent austenite while the prior art specimens of examples 32 and 33 contain about 85 percent martensite and 15 percent austenite.

In order to test the fracture toughness of the processed specimens, compact tension specimens are machined therefrom and then aged for 1 hour at 400° C. The compact tension specimen geometry is shown in FIG. 6. The reference characters in FIG. 6, their meaning, and their measurement in inches are as follows:

| | | | |
|---|---|---|---|
| A | = | height of sample | 2 in. |
| B | = | overall width | 2.125 in. |
| C | = | width to loading line | 1.677 in. |
| D | = | notch depth | 0.875 in. |
| E | = | fatigue crack length | 0.125 in. |
| F | = | fracture ligament size | 1.125 in. |
| G | = | thickness | between 0.155 and 0.165 in. |
| H | = | pin diameter | 0.375 in. |
| X | = | as shown | 0.46 in. |
| Y | = | as shown | 0.46 in. |
| Z | = | C- F | 0.552 in. |

The compact tension specimens are oriented such that the fracture path is perpendicular (LT) to the stretching or rolling direction. LT refers to the ASTM E399 method for designating specimen orientation. The first letter designates the direction of loading and the second letter designated the direction of crack propagation. All specimens are given a sharp notch by fatigue pre-cracking. Each is subjected to tension-tension loading using a sinusoidal stress wave at 10 Hz until the crack has grown 0.125 inch from the machined notch leaving an unfractured ligament 1.125 inches long. The stress intensity range used is 65 ksi$\sqrt{\text{inch}}$ (71.4 Mpa$\sqrt{\text{meter}}$), and typical crack growth rates are on the order of $2 \times 10^{-5}$ inch/cycle. The R value, which is defined as the ratio of minimum to maximum loads, is 0.25.

After fatigue pre-cracking, each specimen is pulled to failure, and the load is recorded as a function of grip displacement. The cross-head speed is 5 inches/hour. Although a linear variable differential transducer, which measures loading pin displacement, is used instead of a clip-on extensometer to measure crack opening, the recommended procedure for determining the point of initial crack advance, as given in ASTM method E399 is otherwise followed.

The observed stress intensity at which crack advance initiates is given under Fracture Toughness in Table II. The values are approximate only since no clip-on extensometer was used to measure crack opening; they are therefore referred to as $K_e$ rather than $K_c$.

In addition to tensile stength of the specimen prior to testing and fracture toughness, test temperature (for fracture toughness) and fracture mode (determined by visual observation) are given in Table II.

TABLE II

| Ex. | Tensile Strength ksi (Mpa) | Test Temperature° C | Fracture Toughness-Ke ksi$\sqrt{\text{inch}}$ (Mpa$\sqrt{\text{meter}}$) | Fracture Mode |
|---|---|---|---|---|
| 32 | 206 (1,419) | 25 | 212 (233) | ductile |
| 33 | 225 (1,550) | −196 | 111 (122) | brittle |
| 34 | 245 (1,688) | 25 | 206 (226) | ductile |
| 35 | 245 (1,688) | −196 | 185 (203) | partially ductile |

The specimens of examples 32 and 33 prepared by the one step cryodeformation technique of the prior art can be compared with the specimens of examples 34 and 35 prepared by the process of this invention. The specimen of example 32 is compared with the specimen of 34 since both are tested at 25° C, and the specimen of example 33 is compared with the specimen of example 35 since both are tested at −196° C.

The increase in tensile strength between prior art specimen 32 and invention specimen 34 is about 19 percent while the decrease in fracture toughness is merely about 2.8 percent. It is apparent that the significant increase in tensile strength had only a minor effect on the fracture toughness whereas the usual prior art effect was that increases in tensile strength resulted in corresponding decreases in fracture toughness.

While the increase in tensile strength between prior art specimen 33 and the invention specimen 35 is just about 8.9 percent, the increase in fracture toughness is a dramatic 67 percent (approx.) and the invention specimen has changed from brittle to partially ductile.

EXAMPLES 36 to 44

Annealed AISI type 302 stainless steel wire is used, the chemical composition being as follows:

| Element | Percent by weight |
|---|---|
| C | 0.07 |
| S | 0.021 |
| P | 0.02 |
| Mn | 0.52 |
| Si | 0.37 |
| Ni | 8.5 |
| Cr | 18.9 |
| Mo | 0.22 |
| Cu | 0.19 |
| V | 0.05 |
| Zr | less than 0.02 |
| Ti | less than 0.01 |
| Al | less than 0.05 |
| Fe | balance |
| Total | 100 |

Annealing is accomplished with conventional techniques by heating the material between 980° C and 1150° C followed by rapid cooling.

The wire is first (except for example 36) conventionally stretched at 21° C using a certain prestrain and is then stretched under liquid nitrogen, all according to the procedure and with the apparatus described above in the specification and in FIGS. 1 and 2. The wire of each example is then aged conventionally for 2 hours at 400° C. Initial wire diameters, percent prestrain at 21° C, percent strain at −196° C and the resulting tensile strength are set forth in Table III. Martensite content of the processed wires of each example (except for example 36) is at least 60 percent by volume.

TABLE III

| Example | Wire Diameter in inches | Strain at 21° C % | Strain at −196° C % | Tensile Strength ksi (Mpa) |
|---|---|---|---|---|
| 36 | 0.027 | 0 | 20.0 | 255 (1,757) |
| 37 | 0.0248 | 20.0 | 20.0 | 266 (1,833) |
| 38 | 0.125 | 21.4 | 16.7 | 260 (1,791) |
| 39 | 0.119 | 30.9 | 20.6 | 284 (1,957) |
| 40 | 0.119 | 31.1 | 21.1 | 279 (1,922) |
| 41 | 0.117 | 38.2 | 18.4 | 290 (1,998) |
| 42 | 0.118 | 38.2 | 16.8 | 290 (1,998) |
| 43 | 0.113 | 42.6 | 21.4 | 301 (2,074) |
| 44 | 0.109 | 55.0 | 20.3 | 308 (2,122) |

EXAMPLES 45 to 55

These examples are concerned with both tensile strength and torsional yield strength.

The torsional yield strength of wire, for example, can be determined by twisting a finite length of wire over increasing angles and observing when a first permanent angular distortion occurs. A two percent torsional yield strength is defined as the shear stress occurring at the surface of the wire when twisted over an angle sufficient to give rise to a two percent permanent regular offset. A similar definition holds for a five percent torsional yield strength. It is desirable that the torsional yield strength of a wire used for spring applications be as high as possible in relation to the tensile strength of the wire.

Annealed AISI type 302 stainless steel wire having the same composition as that of examples 36 to 44 is used, and the annealing process used in its preparation is also the same. After deformation all specimens are subjected to conventional ageing at 400° C. Stretching or drawing or 21° C is accomplished conventionally. Stretching at 196° C is done under liquid nitrogen at minus 196° C according to the procedure and with the apparatus described above in the specification and in FIGS. 1 and 2. Martensite content of all specimens processed at −196° C is at least 60 percent by volume.

The processing at minus 196° C is done in an insulated metal dewar filled with liquid nitrogen so that the entire specimen is immersed in a liquid nitrogen bath. Ageing treatment is carried out on a Lindberg Model 59744 furnace in air. The surface oxidation of the wire occurring during ageing is assumed not to affect the resulting mechanical properties. The temperature along the length of all specimens does not vary more than ± 10° C from the preset temperature.

Percent by volume martensite is given as determined by quantitative X-ray difference technique. The balance (to make up a total of 100 percent) is considered to be austenite. Other phases or impurities are not more than one percent by volume and are not considered here.

Tensile tests for all examples are performed according to ASTM method E8 and torsional tests as described above.

The wire of examples 45, 46, 47, and 49 through 54 show adequate formability in that it can be wrapped around an arbor equal to the final wire diameter without fracture.

The strain applied at 21° C in examples 45 and 49 through 54 is accomplished by conventional stretching; in examples 48 and 55 by conventional drawing at full hard; and in example 47 by conventional drawing at ¼ hard. The strain applied at −196° C in all examples except 48 and 55 is, of course, by stretching. In example 46, no strain is applied at 21° C and in examples 48 and 55, no strain is applied at −196° C.

Strain percent, final wire diameter, tensile strength after ageing, torsional yield strength after ageing, and the ratio of torsional yeild strength to tensile strength are given in Table IV.

Table IV

| Example | Strain (%) 21° C | Strain (%) −196° C | Final wire diameter in inches | Tensile strength ksi (Mpa) | Torsional yield strength 2% ksi (Mpa) | Torsional yield strength 5% ksi (Mpa) | Ratio: 2% torsional yield strength to tensile strength |
|---|---|---|---|---|---|---|---|
| 45 | 20 | 20 | 0.0248 | 266 (1,833) | 135 (930) | 161 (1,109) | 0.51 |
| 46 | 0 | 20 | 0.0270 | 256 (1,764) | 132 (909) | 154 (1,061) | 0.52 |
| 47 | at least 20 | 20 | 0.0276 | 270 (1,860) | 130 (896) | 166 (1,144) | 0.48 |
| 48 | at least 75 | 0 | 0.0270 | 312 (2,150) | 105 (723) | 142 (978) | 0.34 |
| 49 | 30.9 | 20.6 | 0.1189 | 284 (1,957) | 151 (1,040) | 181 (1,247) | 0.53 |
| 50 | 31.1 | 21.1 | 0.1186 | 279 (1,922) | 133 (916) | 173 (1,192) | 0.48 |
| 51 | 38.2 | 18.4 | 0.1168 | 290 (1,998) | 143 (985) | 183 (1,261) | 0.49 |
| 52 | 38.2 | 16.8 | 0.1177 | 290 (1,998) | 138 (951) | 174 (1,199) | 0.48 |
| 53 | 42.6 | 21.5 | 0.1135 | 301 (2,074) | 149 (1,027) | 186 (1,282) | 0.50 |
| 54 | 55.0 | 20.3 | 0.1094 | 308 (2,122) | 164 (1,130) | 195 (1,344) | 0.53 |
| 55 | at least 75 | 0 | 0.1180 | 269 (1,853) | 108 (744) | 144 (992) | 0.40 |

We claim:

1. A process for improving the strength-toughness characteristics of an austenitic metal alloy selected from the group consisting of stainless steel alloys of the AISI 200 and 300 series and non-stainless steel alloys containing iron, manganese chromium, and carbon, said alloy having an Md temperature of no higher than about 100° C and an Ms temperature of no higher than about minus 100° C comprising the following steps:

a. deforming the alloy at a strain of at least about 10 percent and at a temperature in the range of about Md minus 50° C to about Md plus 50° C, said Md temperature being that of the alloy undergoing deformation, in such a manner that the material has a martensite phase of no greater than about 10 percent by volume and an austenite phase of at least about 90 percent by volume; and b. deforming the material produced in step (a) at a strain of at least about 10 percent and at a temperature no higher than about minus 75° C in such a manner that the material has a martensite phase of at least about 50 percent by volume and an austenite phase of at least about 10 percent by volume.

2. The process defined in claim 1 comprising the following additional step:

c. ageing the material produced in step (b) at a temperature in the range of about 350° C to about 450° C.

3. The process defined in claim 2 wherein, in step (a), the strain is about 10 to about 80 percent and, in step (b), the strain is about 10 to about 60 percent, the temperature is less than about minus 100° C, and the product of step (b) has a martensite phase of at least about 60 percent by volume and an austenite phase of at least about 10 percent by volume.

4. The process defined in claim 3 wherein step (c) is carried out at a temperature in the range of about 375° C to about 425° C.

5. A crystalline microstructure consisting essentially of a stainless steel alloy of the AISI 300 series having a martensite phase of at least about 50 percent by volume and an austenite phase of at least about 10 percent by volume and wherein the tensile strength of the alloy is at least about 190,000 pounds per square inch where the microstructure contains 50 percent martensite by volume and the tensile strength increases by at least about 2000 pounds per square inch for each additional percent of martensite above 50 percent.

6. The microstructure defined in claim 5 wherein the martensite phase is at least about 60 percent by volume and the austenite phase is at least about 10 percent by volume.

7. A method for improving the strength-toughness characteristics of wire or strip, the composition of which consists essentially of a stainless steel alloy of the AISI 300 series, having an Md temperature of no higher than about 100° C and an Ms temperature of no higher than about minus 100° C comprising the following steps:

a. deforming the wire or strip at a strain of at least about 10 percent and at a temperature in the range of about Md minus 50° C to about Md plus 50° C, said Md temperature being that of the alloy undergoing deformation, in such a manner that the wire or strip has a martensite phase of no greater than about 10 percent by volume and an austenite phase of at least about 90 percent by volume; and b. stretching the wire or strip uniaxially at a strain of at least about 10 percent and at a temperature no higher than about minus 75° C in such a manner that the wire or strip has a martensite phase of at least about 50 percent by volume and an austenite phase of at least about 10 percent by volume.

8. The process defined in claim 7 comprising the following additional step:

c. ageing the material produced in step (b) at a temperature in the range of about 350° C to about 450° C.

9. The process defined in claim 8 wherein, in step (a), the strain is about 10 to about 80 percent and, in step (b), the strain is about 10 to about 60 percent, the temperature is less than minus 100° C, and the product of step (b) has a martensite phase of at least about 60 percent by volume and an austenite phase of at least about 10 percent by volume.

10. The process defined in claim 9 wherein step (c) is carried out at a temperature in the range of about 375° C to about 425° C.

11. The process defined in claim 1 wherein the material is a stainless steel alloy of the AISI 300 series.

12. The process defined in claim 2 wherein the material is a stainless steel alloy of the AISI 300 series.

13. The process defined in claim 3 wherein the material is a stainless steel alloy of the AISI 300 series.

14. The process defined in claim 4 wherein the material is a stainless steel alloy of the AISI 300 series.

* * * * *